United States Patent [19]

Gaulin

[11] Patent Number: 4,964,470

[45] Date of Patent: Oct. 23, 1990

[54] SPRINKLER CONNECTION TO SCRUBBER DUCT

[75] Inventor: Donald Gaulin, Lunenberg, Mass.

[73] Assignee: McDonald Plumbing & Heating Inc., Mass.

[21] Appl. No.: 269,730

[22] Filed: Nov. 10, 1988

[51] Int. Cl.[5] ..... A62C 37/30

[52] U.S. Cl. ..... 169/56; 169/54

[58] Field of Search ..... 169/56, 59, 66, 46, 169/91, 37, 45, 51

[56] References Cited

U.S. PATENT DOCUMENTS

| | | | |
|---|---|---|---|
| 2,297,808 | 10/1942 | Soucy | 169/61 |
| 2,890,758 | 6/1959 | Pfalzgraff | 169/37 |
| 2,988,150 | 6/1961 | Smith | 169/2 |
| 2,989,348 | 6/1961 | Reed | 169/54 |
| 3,052,303 | 9/1962 | Lapp | 169/56 |
| 3,388,747 | 6/1968 | Hodnett | 169/41 |
| 3,403,733 | 10/1968 | Terry | 169/56 |
| 3,763,936 | 10/1973 | Menage | 169/1 A |
| 3,871,458 | 3/1975 | Dumazet | 169/45 |
| 4,519,458 | 5/1985 | Kroeter | 169/56 |
| 4,633,967 | 1/1987 | Kranz | 169/56 |
| 4,664,197 | 5/1987 | Leduc | 169/57 |

*Primary Examiner*—Joseph F. Peters, Jr.
*Assistant Examiner*—Clifford T. Bartz

[57] ABSTRACT

An improved sprinkler connection to a scrubber duct of the kind carrying noxious and inflammable gases is disclosed. The improved sprinkler connection features a small, single entry port into the duct, means for removably mounting a sprinkler head through the port into the duct, and a flexible hose for connecting the sprinkler head to a source of fluid supply. Preferably, the entry port does not exceed two inches in diameter. Preferably, the means for removably mounting the sprinkler head includes a reducer coupling. The reducer coupling serves to effect fluid communication between the sprinkler head and the flexible hose.

20 Claims, 2 Drawing Sheets

SPRINKLER CONNECTION TO SCRUBBER DUCT

BACKGROUND OF THE INVENTION

1. Field of the Invention

The present invention relates generally to ductworks designed to remove noxious and flammable vapors and gases from industrial plants and, more particularly, to an improved sprinkler connection to a scrubber duct.

2. The Prior Art

Industrial plants generate unwanted and undesirable byproducts, including noxious and flammable vapors and gases. These noxious and flammable vapors and gases must be removed from the premises preferably at the rate that they are generated. Ductworks operated at negative pressures are designed to do so. They are better known as scrubber ducts. Since scrubber ducts frequently carry vapors and gases which are pyrophoric and highly volatile, they are required to be outfitted with sprinklers inside the ducts. Water is channeled to each of the sprinklers via hard pipes entering into the ducts, right up to the sprinkler heads. These sprinkler heads must be inspected regularly to assure the operational integrity of the system. Sprinklers found defective must be replaced. The installation, the inspection and the replacement of each of the sprinklers requires the provision of a second port, the access port, adjacent each and every one of the sprinkler heads mounted at intervals in the ducts. The ducts are tubular, with the sprinkler heads mounted from the top. The access ports preferably are provided at a 45° angle thereto. In order to enable an operator to install, to inspect, and if need be, to replace a defective sprinkler head, the access ports must each be at least six inches in diameter. The opening of even one of these six inch access ports, however, reduces the negative pressure within the duct to below that required to keep the system operational. Consequently, the entire duct system must be shut down during the periodic inspection procedure and remain shut down until the last sprinkler head in the duct system has been inspected and, if need be, replaced. And of course, with the entire scrubber duct system shut down, the particular industrial process served by that process also had to be shut down, and remain shut down until the inspection of the ducts system has been completed and rendered operational once again.

Such periodic inspections, therefore, are very costly. Not only are the manual inspections labor intensive, but in requiring system shut-downs, have the potential to wreak havoc with the efficient operation of the entire plant served by the system. An inspection procedure allowing for the continued operation of the manufacturing process during the scrubber duct's inspection, accordingly, has been a coveted goal for some time.

SUMMARY OF THE INVENTION

It is a principal object of the present invention to overcome the above disadvantages by providing an improved sprinkler connection to duct systems of the kind conveying noxious and potentially flammable gases away from manufacturing operations, which sprinkler connections, among others, allow for their inspection and replacement without also requiring the shut-down of the manufacturing operation which they serve.

More specifically, it is an object of the present invention to provide an improved sprinkler connection to a scrubber duct carrying noxious and flammable vapors, chemicals and gases, which sprinkler connection requires but a small, single entry port into the duct for the installation, inspection and replacement of each one of the plurality of sprinkler heads contained in the entire system, and that without the necessity of shutting down either the duct system or the thereon dependent manufacturing operation. The improved sprinkler connection to the scrubber duct essentially comprises means, including a reducer coupling, for removably mounting the sprinkler head within the scrubber duct, and a flexible hose for connecting the sprinkler head to a source of fluid supply. Preferably, the entry port does not exceed two inches in diameter.

Other objects of the present invention will in part be obvious and will in part appear hereinafter.

The invention accordingly comprises the improved sprinkler connection to a scrubber duct of the present disclosure, its components, parts, and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
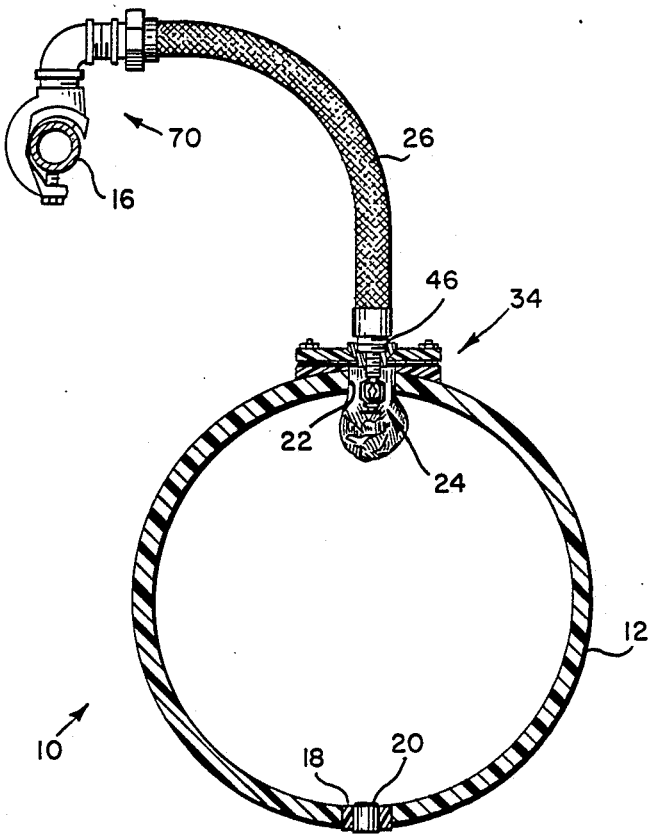
FIG. 1 is an end elevation, partly in section, of a sprinkler connection to a scrubber duct constructed in accordance with the present invention.

In general, the illustrated embodiment of a sprinkler connection to a scrubber duct system 10 is designed for use in industrial plants to carry and remove obnoxious and flammable vapors and gases, the unwanted by-products of the specific industrial processes employed therein. Fire regulationsa require that the sprinklers in the ducts be inspected on a regular basis, such as monthly, to assure the operational integrity of the system. Such inspections are labor intensive and time consuming, hence expensive. The sprinkler connection to the scrubber duct system 10 according to the invention achieves economies in the inspection of such systems and, where need be, in the replacement of sprinklers found to be defective.

The sprinkler connection to the scrubber duct system 10 essentially comprises a scrubber duct 12 proper, and a sprinkler connecting system 14 flexibly coupling the scrubber duct 12 to a water main 16 carrying water under pressure. Preferably, the water main 16 and the scrubber duct 12 are mounted in parallel spaced apart relationship to one another. Preferably, the distance separating the water main 16 from the scrubber duct 12 is about two to about three feet.

Preferably, the scrubber duct 12 is a fiber reinforced plastic tube, with an internal diameter ranging from about ten to about forty inches. Preferably, the scrubber duct 12 is mounted a few inches from the floor and is provided with one or more drain connection 18 leading to the floor. The drain connection 18 is covered with a pressure fit cap 20. Depending on factory layout, the scrubber duct 12 can vary in axial length anywhere from about 100 to about 600 feet. Preferably, the scrubber duct 12 is designed to operate at a negative static pressure within a range from about three to about ten inches. As known, the scrubber duct 12 is designed operatively to be connected to industrial machinery along its axial length. Preferably, the operational parameters of size, specifically the internal diameter, and of the degree of negative static pressure with which the scrubber duct 12 is operated, are selected so that the noxious and flammable vapors and gases generated by the industrial machinery connected thereto are removed thereby at least at the same rate at which they are generated. Usually, the scrubber duct 12 is a component part of a more complex ductwork, including processing equipment, such as ovens, vacuum test chambers, and the like.

Figure 2:
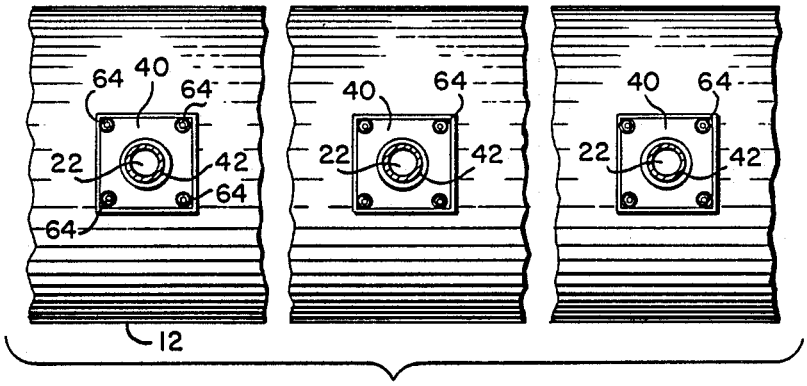
FIG. 2 is a fragmentary plan view of the scrubber duct of FIG. 1 and illustrating parts of the sprinkler connection thereof.
Figure 3:
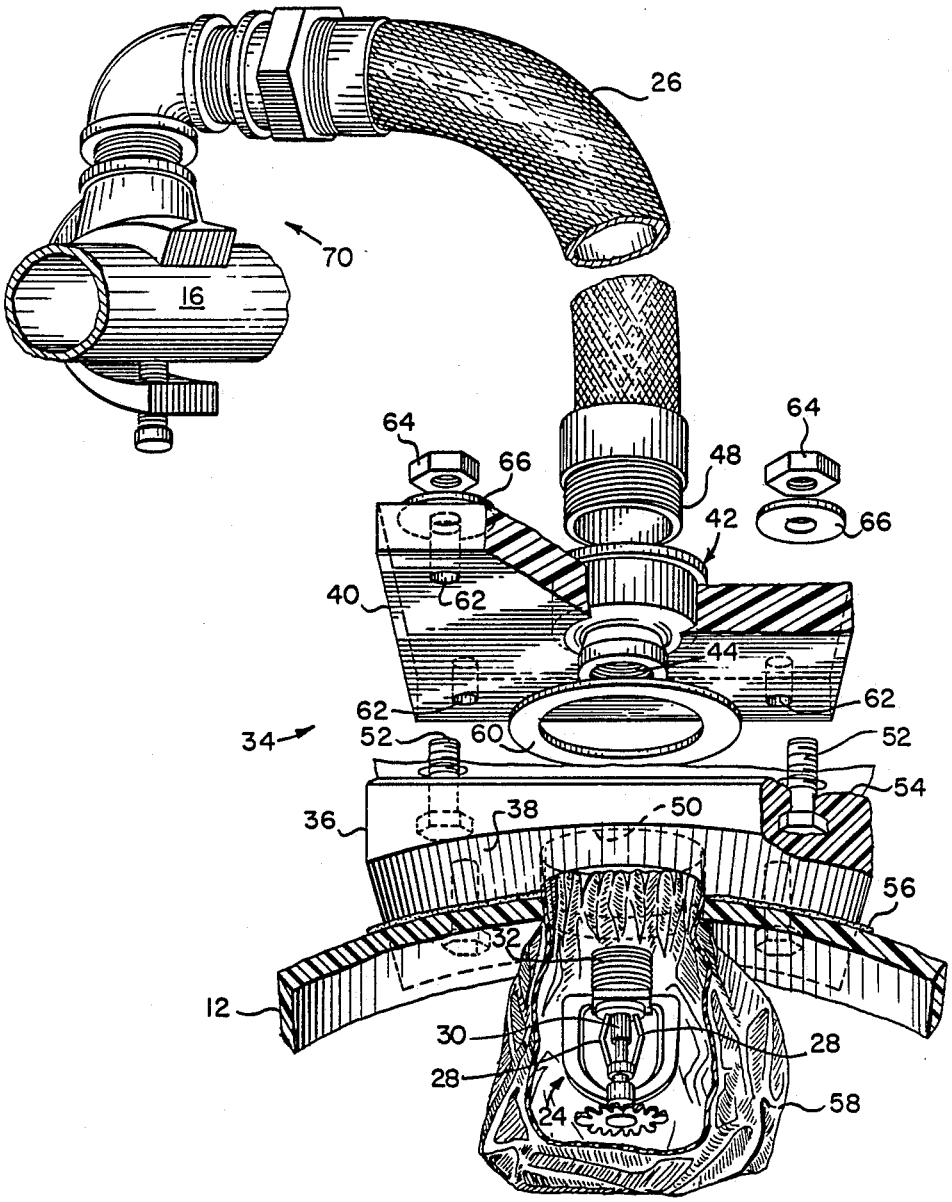
FIG. 3 is an exploded perspective view, partly fragmentary and in section, on an enlarged scale, of the sprinkler connection to the scrubber duct illustrated in FIG. 1.

A single entry port 22 is provided in the scrubber duct 12, preferably at its vertex, for each one of the several sprinkler connecting systems 14 employed along the axial length of the scrubber duct 12, note FIG. 2. The diameter of the single entry port 22 does not exceed two inches, for reasons more fully explained below and, preferably is less than two inches, on the order of about one and three-quarter inches.

The sprinkler connection system 14 to the scrubber duct 12 essentially comprises a sprinkler head 24 designed to be inserted via the single entry port 22 into the scrubber duct 12 and a flexible hose 26 designed for connecting the sprinkler head 24 to a source of fluid supply, that is the water main 16 or a branch thereof.

The sprinkler head 24 is of known conventional design and, as such, is provided with a pair of flexible links 28 designed to melt at about 165° F. When due to heat and/or fire, the links 28 do melt, a central plug 30 is dislodged by the force of water pressure acting against it, and water begins to sprinkle from the sprinkler head 24. The tubular water-connecting portion of the sprinkler head 24 is externally threaded, as at 32.

Means 34 are provided for removably mounting the sprinkler head 24 within the scrubber duct 12. Means 34 comprises a mounting block 36 formed with a contoured underside 38, contoured to follow the outside curved surface of the scrubber duct 12, a mounting plate 40 designed to be removably secured to the mounting block 36, and a reducer coupling 42 mounted to and within the mounting plate 40. Preferably, both the mounting block 36 and the mounting plate 40 are formed of the same fiber reinforced plastic material as is the scrubber duct 12, such as a polyester fiberglass composite material. The reducer coupling 42 preferably is, however, formed of stainless steel, as is the flexible hose 26.

The reducer coupling 42 is formed of two concentric internally-threaded portions but with different sized diameters. A first internally-threaded portion 44 is designed to mesh with the externally-threaded portion 32 of the sprinkler head 24. A second internally-threaded portion 46, on the other head, is designed to receive therein an externally-threaded end portion 48 of the flexible hose 26.

The mounting block 36 is formed with a central hole 50 whose diameter preferably matches the diameter of the single entry port 22. The mounting block 36 furthermore is provided with a plurality of bolts 52 partially embedded therein and partially extending therefrom through an upper flat surface 54 thereof. Preferably, the mounting block 36 is permanently secured to the scrubber duct 12 in any known and convenient manner, as for instance by a layer of adhesive 56, which may be an epoxy or polyester resin, or the like. A protective shroud 58 in the form of a polyethylene bag, preferably is provided to surround the sprinkler head 24 and to protect the same from the adverse effects of corrosive vapors and gases. In case of fire or heat in excess of about 165° F., the shroud 58 also will melt and thus presents no impediment to water sprinkling from the sprinkler head 24 into the interior of the scrubber duct 12. The outer ends of the shroud 58 are conveniently impaled on the protruding bolts 52 and are supported thereby. Preferably, a rubber gasket 60 is intended to be interposed between the upper flat surface 54 of the mounting block 36 and the flat underside of the mounting plate 40 so as to achieve an airtight connection therebetween.

The mounting plate 40 is provided with matching holes 62 to allow for the passing therethrough of the bolts 52. Matching nuts 64 and washers 66 secure, removably, the mounting plate 40 to the mounting block 36.

The upper end of the flexible hose 26 is secured to and about the water main 16 by a mounting assembly 70 so as to be in fluid communication therewith.

With the sprinkler connection to the scrubber duct system 10 of the invention in place, the task of inspection, maintenance and replacement of defective sprinkler heads 24 has been rendered less burdensome and, more significantly, less costly. First, the line of industrial equipment served by the scrubber duct system 10 need no longer be shut down during the inspection, maintenance and/or replacement of defective sprinkler heads 24. Second, the scrubber duct system 10 also needs no longer to be shut down as its internal negative static pressure, at which it is being operated within the range from about three inches to about ten inches, is no longer adversely affected. This is so for two reasons: 1/ the sprinkler connection to the scrubber duct system 10 employs but the single entry port 22 for its inspection, maintenance and replacement procedure—the heretofore required relatively large (six inches) access ports formed in the scrubber duct 12 adjacent each and every one of the sprinkler heads 24 have now been eliminated; and 2/ the single entry port 22 is formed with a diameter not exceeding two inches.

Since the inspection and, if need be, replacement of the sprinkler heads 24 is done seriatim, no noticeable change occurs in the internal negative static pressure in the duct system 10. The inspection, maintenance and replacement procedure is rendered possible by the combination of employing the flexible hose 26 in conjunction with the means 34 for replaceably mounting each one of the plurality of sprinkler heads 24 within the scrubber duct 12.

A maintenance worker simply loosens and removes the four nuts 64 from the bolts 52 protruding from the corner of the mounting plate 40. With the nuts 64 off, the worker then removes the sprinkler head 24 from within the duct 12 by grabbing the mounting plate 40 and pulling it up and away from the mounting block 36. The mounting plate 40 has permanently secured therein the reducer coupling 42, as by being bonded thereto during manufacture. And the reducer coupling 42 in turn has attached thereto both the free end of the flexible hose 26 and the sprinkler head 24. The polyethelene shroud 52 also can be removed and inspected simultaneously with the removal of the sprinkler head 24, if desired, by grabbing the corners of the shroud 58 impaled over the bolts 52. If either the shroud 58 is torn or the sprinkler head 24 is found defective, either or both is now replaced, the latter by being unscrewed from the reducer coupling 42. Following inspection and/or replacement, the shroud 58 again is impaled over the bolts 52 and the mounting plate 40 together with the sprinkler head 24 is reattached to the mounting block 36, and with the nuts 64 tightened over the washers 66, that particular sprinkler head 24 has been serviced. The worker then proceeds to do the same with the next succeeding sprinkler connection system 14.

The removal of a single sprinkler head 24 at a time uncovers only one hole in the scrubber duct 12. Since that hole, the single entry port 22, has a diameter not exceeding two inches, the resultant entry of atmospheric air into the scrubber duct 12 for the short period of time required for inspection and/or replacement of either or both the shroud 58 and the sprinkler head 24 is not significant so as to adversely affect the operation of the scrubber duct system.

Thus it has been shown and described an improved sprinkler connection to a scrubber duct system 10, which system 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A sprinkler connection to a scrubber duct of the kind carrying noxious and inflammable gases comprising:

(a) a scrubber duct;
(b) a single entry port of circular cross section provided in said duct;
(c) a sprinkler head enclosed within a shroud and designed to be inserted via said port into said duct;
(d) means for removably mounting said sprinkler head and said shroud within said duct; and
(e) a flexible hose for connecting said sprinkler head to a source of fluid supply.

2. A sprinkler connection to a scrubber duct of the kind carrying noxious and inflammable gases comprising:

(a) a scrubber duct;
(b) a single entry port provided in said duct;
(c) a sprinkler head designed to be inserted via said port into said duct;
(d) means for removably mounting said sprinkler head within said duct; and
(e) a flexible hose for connecting said sprinkler head to a source of fluid supply;
(f) said sprinkler head provided with a fusible link designed to melt at about 165° F., and further including a shroud surrounding said sprinkler head and designed to be removably mounted therewith.

3. The sprinkler connection of claim 2 wherein said scrubber duct is a fiber reinforced plastic tube of a diameter ranging from about ten inches to about forth inches and wherein said single entry port is of a diameter not exceeding about two inches.

4. The sprinkler connection of claim 2 wherein said means for removably mounting said sprinkler head includes a reducer coupling designed to effect fluid communication between said sprinkler head and one end of said flexible hose.

5. The sprinkler connection of claim 4 wherein said means for removably mounting said sprinkler head further includes a mounting block contoured to sit on said duct about said entry port and provided with a central hole and at least one bolt, and a mounting plate having said reducer coupling attached thereto and provided with at least one opening to admit said one bolt therethrough.

6. The sprinkler connection of claim 5 wherein said means for removably mounting said sprinkler head further includes a gasket to be secured inbetween said mounting block and said mounting plate, and wherein said mounting block is adhesively secured to said duct about said entry port.

7. The sprinkler connection of claim 2 wherein said fiber reinforced plastic tube is designed to operate at a negative static pressure in a range from about three to about ten inches.

8. A sprinkler connection to a scrubber duct of the kind carrying noxious and inflammable gases comprising:

(a) a scrubber duct;
(b) a single entry port provided in said duct;
(c) a sprinkler head designed to be inserted via said port into said duct;
(d) means for removably mounting said sprinkler head within said duct; and
(e) a flexible hose for connecting said sprinkler head to a source of fluid supply;
(f) said means for removably mounting said sprinkler head including a reducer coupling designed to effect fluid communication between said sprinkler head and one end of said flexible hose;
(g) said means for removably mounting said sprinkler head further includes a mounting block contoured to sit on said duct about said entry port and provided with a central hole and at least one bolt, and a mounting plate having said reducer coupling attached thereto and provided with at least one opening to admit said one bolt therethrough;
(h) said mounting bolt and said mounting plate formed of a fiber reinforced plastic material.

9. The sprinkler connection of claim 8 wherein said fiber reinforced plastic material is a polyester fiberglass composite material, and wherein said flexible hose is a stainless steel seamless metal hose.

10. The sprinkler connection of claim 8 wherein said reducer coupling is internally threaded from both of its ends, and wherein said sprinkler head has an externally threaded portion designed to mesh with the internal threads of said reducer coupling from one of its said ends and said one end of said flexible hose has an externally threaded portion designed to mesh with the external threads of said reducer coupling from the other of its said ends.

11. In a duct system of the type conveying noxious and flammable gases, an improved sprinkler connection comprising:

(a) a tubular duct system of a diameter ranging from about ten inches to about forty inches;
(b) a plurality of single entry ports, each of circular cross section and provided in said tubular duct system along its axial length;

(c) a plurality of sprinkler heads designed respectively to be inserted via said plurality of single entry ports into said duct system;
(d) means for removably mounting each of said plurality of sprinkler heads within said duct system; and
(e) a plurality of flexible hoses respectively connecting each of said plurality of sprinkler heads to a source of fluid supply;
(f) each of said plurality of sprinkler heads provided with a shroud surrounding the same and designed to be removably mounted therewith.

12. The duct system of claim 11 wherein said tubular duct system is formed of a fiber reinforced plastic material and wherein each of said plurality of single entry ports is formed with a diameter not exceeding about two inches.

13. In a duct system of the type conveying noxious and flammable gases, an improved sprinkler connection comprising:
(a) a tubular duct system of a diameter ranging from about ten inches to about forty inches;
(b) a plurality of single entry ports provided in said tubular duct system along its axial length;
(c) a plurality of sprinkler heads designed respectively to be inserted via said plurality of single entry ports into said duct system;
(d) means for removably mounting each of said plurality of sprinkler heads within said duct system; and
(e) a plurality of flexible hoses respectively connecting each of said plurality of sprinkler heads to a source of fluid supply;
(f) each of said plurality of sprinkler heads provided with a fusible link designed to melt at about 165° F., and wherein each of said plurality of sprinkler heads is provided with a shroud surrounding the same and designed to be removably mounted therewith.

14. The duct system of claim 13 wherein said means for removably mounting each of said plurality of sprinkler heads includes a reducer coupling designed to effect fluid communication between said sprinkler heads and their respective said plurality of flexible hoses.

15. The duct system of claim 14 wherein said reducer coupling is internally threaded from both of its ends, and wherein each of said plurality of sprinkler heads has an externally threaded portion to mesh with the internal threads of said reducer coupling from one of its said ends and each of said plurality of flexible hoses has an externally threaded portion to mesh with the internal threads of said reducer coupling from the other of its said ends.

16. The duct system of claim 14 wherein said means for removably mounting each of said plurality of sprinkler heads further includes a mounting block having an underside contoured to sit on said tubular duct system about said single entry port and a mounting plate having said reducer coupling mounted therein and designed removably to be secured to said mounting block.

17. The duct system of claim 16 wherein said mounting block is adhesively secured to said tubular duct system, and wherein said tubular duct system is designed to operate at a negative static pressure in a range from about three to about ten inches.

18. The duct system of claim 16 wherein said tubular duct system, said mounting block and said mounting plate are formed of a fiber reinforced plastic material, and wherein said plurality of flexible hoses are stainless steel seamless metal hoses.

19. In a duct system of the type conveying noxious and flammable gases, an improved sprinkler connection comprising:
(a) a tubular duct system of a diameter ranging from about ten inches to about forty inches;
(b) a plurality of single entry ports provided in said tubular duct system along its axial length;
(c) a plurality of sprinkler head designed respectively to be inserted via said plurality of single entry ports into said duct system;
(d) means for removably mounting each of said plurality of sprinkler heads within said duct system; and
(e) a plurality of flexible hoses respectively connecting each of said plurality of sprinkler heads to a source of fluid supply;
(f) said means for removably mounting each of said plurality of sprinkler heads including a reducer coupling designed to effect fluid communication between said sprinkler heads and their respective said plurality of flexible hoses;
(g) said means for removably mounting each of said plurality of sprinkler heads further including a mounting block having an underside contoured to sit on said tubular duct system about said single entry port and a mounting plate having said reducer coupling mounted therein and designed removably to be secured to said mounting block;
(h) said contoured underside of said mounting block being secured to said tubular duct system by an adhesive layer, and wherein said removable securing of said mounting plate to said mounting block is effected by nuts and bolts.

20. The duct system of claim 19 wherein said tubular duct system varies in axial length from about 100 to 600 feet.

* * * * *

UNITED STATES PATENT OFFICE

CERTIFICATE OF CORRECTION

PATENT NO. : 4,964,470

DATED : October 23, 1990

INVENTOR(S) : Donald Gaulin

It is certified that error appears in the above-identified patent and that said Letters Patent is hereby corrected as shown below:

On title page, item [73]

Assignee changed from "McDonald Plumbing & Heating, Inc."

to "MacDonald Plumbing & Heating, Inc."

Signed and Sealed this

Seventh Day of November, 1995

Bruce Lehman

*Attest:*

BRUCE LEHMAN

*Attesting Officer*

*Commissioner of Patents and Trademarks*